US008905764B2

(12) United States Patent
Cheng

(10) Patent No.: US 8,905,764 B2
(45) Date of Patent: Dec. 9, 2014

(54) ROTARY PLUG

(71) Applicant: Wistron Corporation, New Taipei (TW)

(72) Inventor: Xiu-Feng Cheng, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 37 days.

(21) Appl. No.: 13/855,724

(22) Filed: Apr. 3, 2013

(65) Prior Publication Data

US 2014/0213072 A1 Jul. 31, 2014

(30) Foreign Application Priority Data

Jan. 31, 2013 (CN) ..... 2013 1 0039737

(51) Int. Cl.
*H01R 39/00* (2006.01)
*H01R 35/00* (2006.01)

(52) U.S. Cl.
CPC ..... *H01R 35/00* (2013.01)
USPC ..... 439/24

(58) Field of Classification Search
USPC ..... 439/20–26
See application file for complete search history.

(56) References Cited

U.S. PATENT DOCUMENTS 3,860,312 A * 1/1975 Gordon, Jr. ..... 439/31
4,583,798 A * 4/1986 Blazowich ..... 439/24
4,850,880 A * 7/1989 Zayat et al. ..... 439/11
5,205,749 A 4/1993 Weingartner
5,350,310 A * 9/1994 Chen ..... 439/188
5,399,093 A * 3/1995 Schneider et al. ..... 439/21
5,435,731 A * 7/1995 Kang ..... 439/26
5,846,090 A * 12/1998 Lu ..... 439/26
5,997,310 A * 12/1999 Chiu et al. ..... 439/21
6,015,307 A * 1/2000 Chiu et al. ..... 439/139
6,068,490 A * 5/2000 Salzberg ..... 439/25
6,595,782 B1 * 7/2003 Hsiao ..... 439/13
6,638,074 B1 * 10/2003 Fisher ..... 439/22
7,238,028 B2 * 7/2007 Gerard ..... 439/21
7,255,568 B1 * 8/2007 Wu ..... 439/23
7,497,740 B2 * 3/2009 Mei et al. ..... 439/652
7,500,854 B2 * 3/2009 Gottstein ..... 439/13
7,753,682 B2 * 7/2010 Gerard ..... 439/13
8,002,554 B2 * 8/2011 Wadsworth ..... 439/18
8,011,930 B2 * 9/2011 Lee et al. ..... 439/18
8,277,226 B2 * 10/2012 Almouli ..... 439/10
8,360,788 B2 * 1/2013 Wu et al. ..... 439/26

* cited by examiner

*Primary Examiner* — Neil Abrams
(74) *Attorney, Agent, or Firm* — Winston Hsu; Scott Margo

(57) ABSTRACT

A rotary plug includes a base, a plurality of annular slot structures, a plurality of conductive components, a bridging component and a plurality of terminals. An accommodating space is formed on the base. The annular slot structures are respectively disposed on an inner wall of the accommodating space. Each conductive component is disposed inside the corresponding annular slot structure. A protrusion of the conductive component inserts into a hole formed on the annular slot structure. The bridging component is rotatably disposed inside the accommodating space. A first end of the terminal protrudes from a bottom of the bridging component. A second end of the terminal protrudes from a lateral surface of the bridging component and movably inserts into the annular slot structure to electrically contact the conductive component.

19 Claims, 5 Drawing Sheets

ROTARY PLUG

BACKGROUND OF THE INVENTION

1. Field of the Invention

The present invention relates to a plug, and more particularly, to a rotary plug which can rotate its terminals freely.

2. Description of the Prior Art

The consumer electronic industry is prosperous due to popularization of electronic device and increase of service quality, so the electronic device with conveniently operative function is designed according to user's demand. The consumer electronic device can be a portable device, which has enlarged storage of a built-in battery and further provides an external plug for receiving electric power in a wire transmission manner, so as to increase usage time of the electronic device. Terminals of the conventional plug are immovable. A connecting cable of the conventional plug is twisted for adjusting an inserting angle of the terminals relative to a socket when an initial mode of the terminals is not matched with the socket. The conventional plug has drawbacks of inconvenient operating process and easy damage of the connecting cable due to over-bending. Therefore, design of a plug with adjustable terminals is an important issued in the related electronic component industry.

SUMMARY OF THE INVENTION

The present invention provides a rotary plug which can rotate its terminals freely for solving above drawbacks.

According to the claimed invention, a rotary plug includes a base, a first annular slot structure, a second annular slot structure, a first conductive component, a second conductive component, a bridging component, a positive terminal and a negative terminal. An accommodating space is formed on the base. The first annular slot structure is disposed on an inner wall of the accommodating space, and a first hole is formed on the first annular slot structure. The second annular slot structure is disposed on the inner wall of the accommodating space and different from a position of the first annular slot structure. A second hole is formed on the second annular slot structure. The first conductive component is disposed inside the first annular slot structure. The first conductive component includes a first protrusion, and the first protrusion inserts into the first hole. The second conductive component is disposed inside the second annular slot structure. The second conductive component includes a second protrusion, and the second protrusion inserts into the second hole. The bridging component is rotatably disposed inside the accommodating space. A first end of the positive terminal protrudes from a bottom surface of the bridging component. A second end of the positive terminal protrudes from a lateral surface of the bridging component and movably inserts into the first annular slot structure for contacting the first conductive component. A first end of the negative terminal protrudes from the bottom surface of the bridging component. A second end of the negative terminal protrudes from the lateral surface of the bridging component and movably inserts into the second annular slot structure for contacting the second conductive component.

According to the claimed invention, the bridging component is a cylinder, the accommodating space is a circular sunken space, and the cylinder rotatably inserts into the circular sunken space in a loose fit manner.

According to the claimed invention, a depth of the first annular slot structure is substantially greater than a thickness of the first conductive component.

According to the claimed invention, the second end of the positive terminal is clamped by two inner lateral walls of the first annular slot structure for preventing the bridging component from separating from the accommodating space.

According to the claimed invention, the rotary plug further includes a constraining component disposed on the base and the bridging component for preventing the bridging component from separating from the accommodating space.

According to the claimed invention, a length of the first protrusion is substantially greater than a depth of the first hole, and the first protrusion passes through the first hole to protrude out of an outer surface of the base.

According to the claimed invention, a distance between the second end of the positive terminal and the bottom surface of the bridging component is substantially different from a distance between the second end of the negative terminal and the bottom surface of the bridging component.

According to the claimed invention, the rotary plug further includes a third annular slot structure, a third conductive component and a grounding terminal. The third annular slot structure is disposed on the inner wall of the accommodating space and different from position of the first annular slot structure and the second annular slot structure. A third hole is formed on the third annular slot structure. The third conductive component is disposed inside the third annular slot structure. The third conductive component includes a third protrusion, and the third protrusion inserts into the third hole. A first end of the grounding terminal protrudes from the bottom surface of the bridging component. A second end of the grounding terminal protrudes from the lateral surface of the bridging component and movably inserts into the third annular slot structure for contacting the third conductive component.

According to the claimed invention, a distance between the second end of the grounding terminal and the bottom surface of the bridging component is substantially different from distances between the second end of the positive terminal and the bottom surface of the bridging component, and between the second end of the negative terminal and the bottom surface of the bridging component.

According to the claimed invention, the rotary plug further includes a connecting cable. The connecting cable includes a first wire, a second wire and a third wire electrically connected to the second ends of the positive terminal, the negative terminal and the grounding terminal respectively.

According to the claimed invention, the rotary plug further includes a covering component disposed on an outer surface of the base. The wires of the connecting cable pass through the covering component to electrically connect to the second ends of the positive terminal, the negative terminal and the grounding terminal respectively.

The rotary plug of the present invention has advantages of simple structure and easy operation. The rotation angle of the bridging component can be adjusted before connection with the socket, and the rotary plug can be conveniently combined with the socket which is located at a narrow area and has no tolerance space. Thus, the connecting cable does not twist as the rotary plug is electrically connected to the socket, so that the present invention has preferred operation convenience and preferred market competition.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
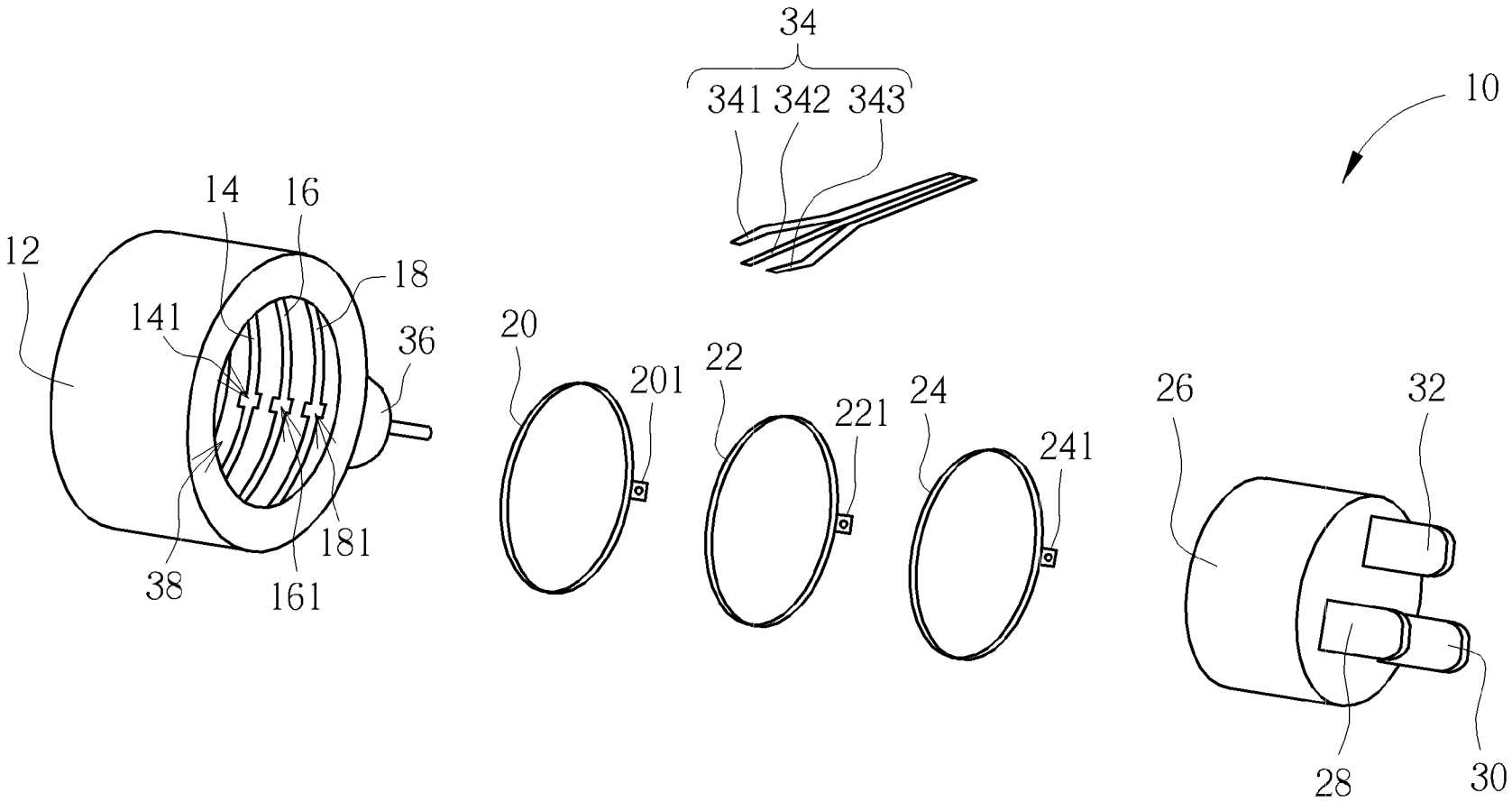
FIG. 1 is an exploded diagram of a rotary plug according to an embodiment of the present invention.
Figure 2:
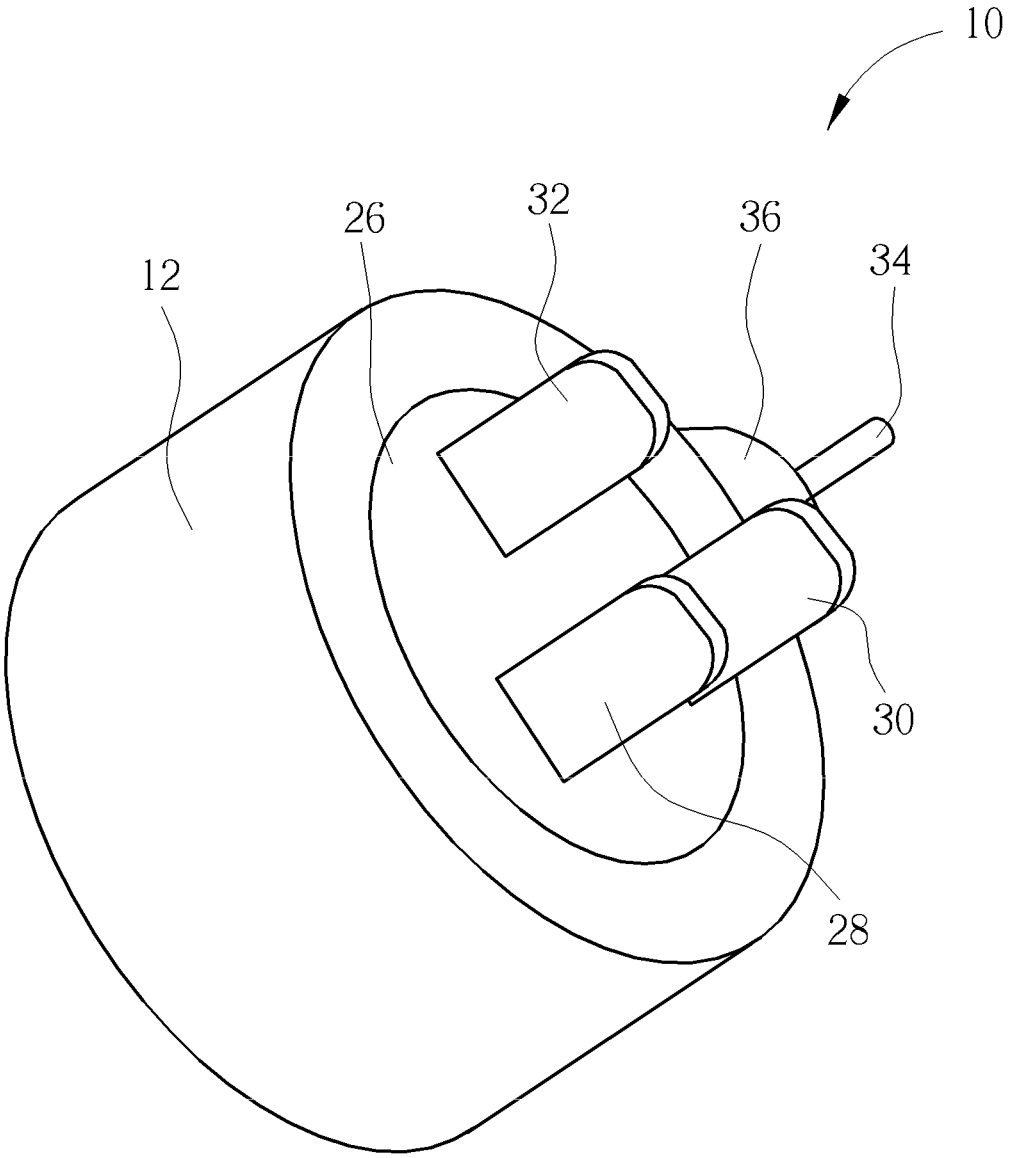
FIG. 2 is an assembly diagram of the rotary plug according to the embodiment of the present invention.

Please refer to FIG. 1 and FIG. 2. FIG. 1 is an exploded diagram of a rotary plug 10 according to an embodiment of the present invention. FIG. 2 is an assembly diagram of the rotary plug 10 according to the embodiment of the present invention. The rotary plug 10 can be a power connector of an electronic product, and the power connector is connected to a socket of a power supply for receiving electric power. The rotary plug 10 includes a base 12, a first annular slot structure 14, a second annular slot structure 16, a third annular slot structure 18, a first conductive component 20, a second conductive component 22, a third conductive component 24, a bridging component 26, a positive terminal 28, a negative terminal 30, a grounding terminal 32, a connecting cable 34 and a covering component 36. An accommodating space 38 is formed on the base 12. The plurality of annular slot structures is arranged separately on an inner wall of the accommodating space 26 without overlap.

As shown in FIG. 1, the first conductive component 20 includes a first protrusion 201. The first conductive component 20 is disposed inside the first annular slot structure 14, and the first protrusion 201 inserts into the first hole 141 on the first annular slot structure 14. The second conductive component 22 includes a second protrusion 221. The second conductive component 22 is disposed inside the second annular slot structure 16, and the second protrusion 221 inserts into the second hole 161 on the second annular slot structure 16. The third conductive component 24 includes a third protrusion 241. The third conductive component 24 is disposed inside the third annular slot structure 18, and the third protrusion 241 inserts into the third hole 181 on the third annular slot structure 18. The conductive components do not contact to each other, so as to prevent the electronic product from damage due to short when each conductive component contacts the corresponding terminal.

Figure 3:
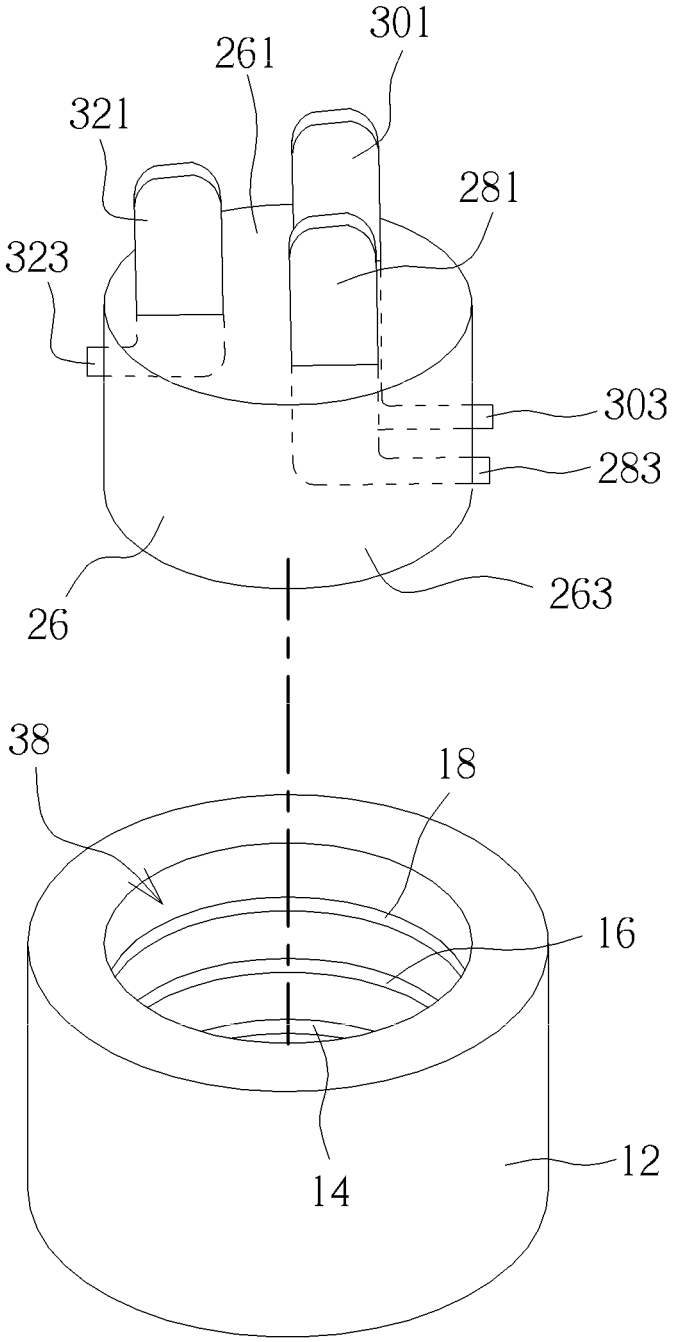
FIG. 3 is a diagram of a bridging component and a base according to the embodiment of the present invention.

Please refer to FIG. 1 to FIG. 3. FIG. 3 is a diagram of the bridging component 26 and the base 12 according to the embodiment of the present invention. The bridging component 26 can be a cylinder, the accommodating space 38 of the base 12 can be a circular sunken space, and the bridging component 26 inserts into the accommodating space 38 in a loose fit manner, so that the bridging component 26 can axially rotate relative to the base 12. The terminals are respectively disposed on different positions on the bridging component 26. As shown in FIG. 3, a first end 281 of the positive terminal 28 protrudes from a bottom surface 261 of the bridging component 26, and a second end 283 of the positive terminal 28 protrudes from a lateral surface 263 of the bridging component 26. A first end 301 of the negative terminal 30 protrudes from the bottom surface 261, and a second end 303 of the negative terminal 30 protrudes from the lateral surface 263. A first end 321 of the grounding terminal 32 protrudes from the bottom surface 261, and a second end 323 of the grounding terminal 32 protrudes from the lateral surface 263.

When the bridging component 26 is disposed inside the accommodating space 38, the second end 283 of the positive terminal 28 can slidably insert into the first annular slot structure 14 to contact the first conductive component 20, the second end 303 of the negative terminal 30 can slidably insert into the second annular slot structure 16 to contact the second conductive component 22, the second end 323 of the grounding terminal 32 can slidably insert into the third annular slot structure 18 to contact the third conductive component 24. Therefore, each terminal can be electrically connected to the corresponding conductive component no matter what rotation angle of the bridging component 26 relative to the base 12 is.

As shown in FIG. 1, the connecting cable 34 further includes a first wire 341, a second wire 342 and a third wire 343. The first wire 341 is electrically connected to the positive terminal 28 via the first protrusion 201. The second wire 342 is electrically connected to the negative terminal 30 via the second protrusion 221. The third wire 343 is electrically connected to the grounding terminal 32 via the third protrusion 241. When the rotary plug 10 of the present invention is electrically connected to the power supply, the electric power is transmitted to the electric product whereon the rotary plug 10 is disposed via the terminal, the conductive component and the connecting cable in sequence. The present invention further disposes the covering component 36 on an outer surface of the base 12 to cover the above-mentioned hole for preferred aesthetic and safety protection. The wires of the connecting cable 34 pass through the covering component 36 to electrically connect to the second ends of the terminals respectively, so that a joint of the connecting cable 34 and the terminals can be isolated by the covering component 36 for preventing electric leakage and preventing the joint of the connecting cable 34 and the terminals from damage by the accidental hit.

Figure 4:
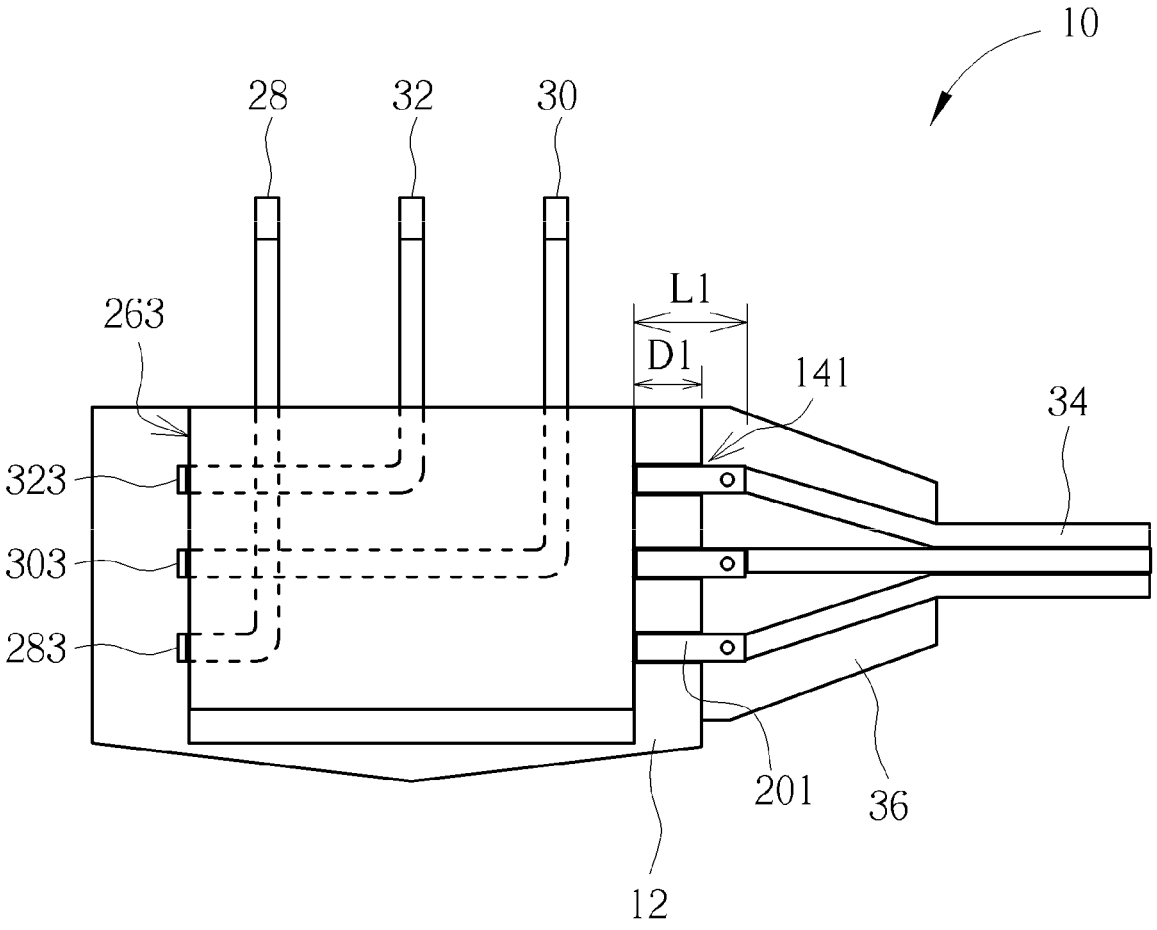
FIG. 4 is a sectional view of the rotary plug according to the embodiment of the present invention.

Please refer to FIG. 4. FIG. 4 is a sectional view of the rotary plug 10 according to the embodiment of the present invention. The bridging component 26 of the rotary plug 10 can rotate relative to the base 12 arbitrarily according to user's demand. Parts of the positive terminal 28, the negative terminal 30 and the grounding terminal 32 protrude from the lateral surface 263 of the bridging component 26 are arranged separately, so as to prevent the terminals from short due to accidentally electrical connection. As shown in FIG. 4, a distance between the second end 283 of the positive terminal 28 and the bottom surface 261 of the bridging component 26 is substantially different from (can be greater or smaller than) a distance between the second end 303 of the negative terminal 30 and the bottom surface 261. Further, and a distance between the second end 323 of the grounding terminal 32 and the bottom surface 261 is substantially different from (can be greater or smaller than) distances between the second end 283 and the bottom surface 261, and between the second end 303 and the bottom surface 261, respectively. For example, the second end 283 of the positive terminal 28 has the highest position, the second end 323 of the grounding terminal 32 has the lowest position, and the second end 303 of the negative terminal 30 is located between the positive terminal 28 and the grounding terminal 32.

As shown in FIG. 4, a length L1 of the first protrusion 201 is preferably greater than a depth D1 of the first hole 141. The first protrusion 201 passes through the first hole 141 to protrude out of the outer surface of the base 12, so the first conductive component 20 can be electrically connected to the connecting cable 34 conveniently, and the covering component 36 is disposed over the joint of the first protrusion 201 and the connecting cable 34 for protection. A structural proportion of the second protrusion 221 to the second hole 161 (and a structural proportion of the third protrusion 241 to the third hole 181) can be substantially identical with a structural proportion of the first protrusion 201 to the first hole 141. The length of the protrusion further can be smaller than the depth of the hole, and the conductive component can insert into the hole to electrically connect to the protrusion. Disposition of above-mentioned structure depends on design demand, and a detailed description is omitted herein for simplicity.

Figure 5:
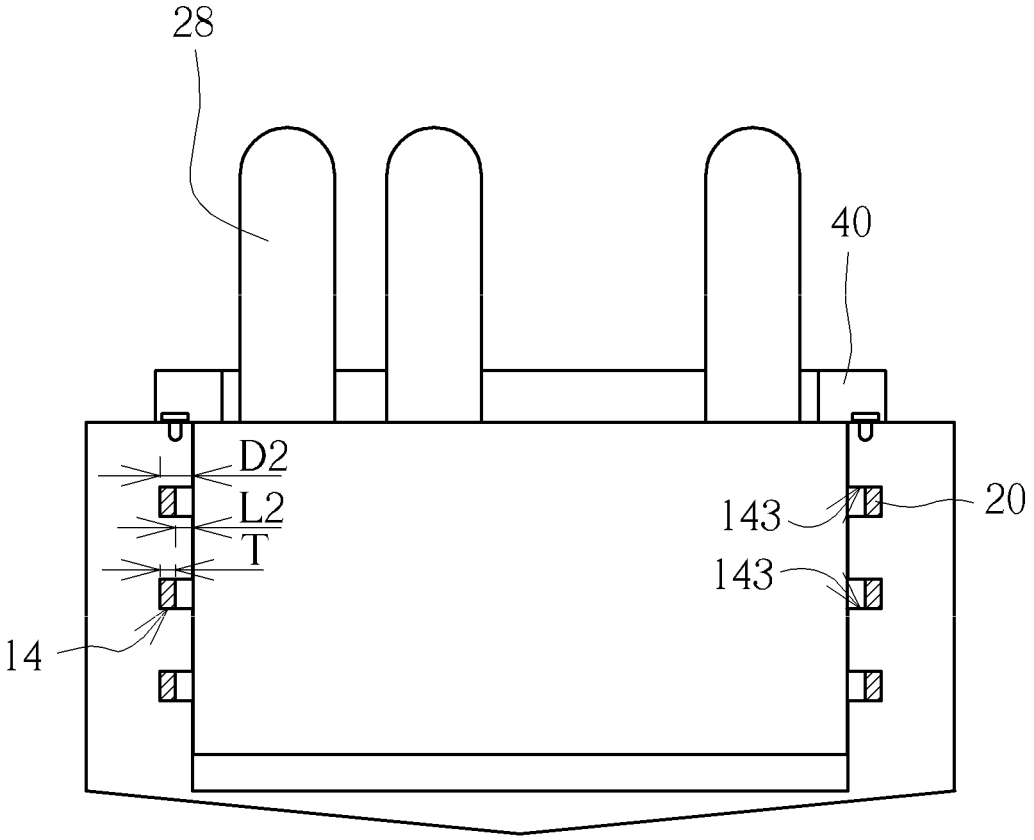
FIG. 5 is a sectional view of the rotary plug in the other view angle according to the embodiment of the present invention.

Please refer to FIG. 5. FIG. 5 is a sectional view of the rotary plug 10 in the other view angle according to the embodiment of the present invention. Each conductive component of the present invention can be stably disposed inside the corresponding annular slot structure at any rotation angle of the bridging component 26 relative to the base 12, and each terminal can keep the electrical connection with the corresponding conductive component. For example, the depth D2 of the first annular slot structure 14 can be substantially greater than the thickness T of the first conductive component 20, so that the first conductive component 20 tightly contacts against the bottom of the first annular slot structure 14. When the bridging component 26 is disposed inside the accommodating space 38, the second end 283 of the positive terminal 28 can insert into the first annular slot structure 14 and contact against the first conductive component 20. The length L2 of part of the second end 283 protruding from the lateral surface 263 of the bridging component 26 can be preferably equal to difference value of the depth D2 and the thickness T, and the second end 283 can be tightly engaged with the first annular slot structure 14 in a slidable manner. It is to say, an upper side and a low side of the second end 283 of the positive terminal 28 are clamped by two inner lateral walls 143 of the first annular slot structure 14, and a movement of the bridging component 26 relative to the base 12 is effectively constrained, so as to prevent the bridging component 26 from separating from the accommodating space 38. The proportion of the other annular slot structure to the conductive component and the terminal are the same as ones of the above-mentioned embodiment, and a detailed description is omitted herein for simplicity.

Besides, the rotary plug 10 of the present invention can selectively include a constraining component 40 disposed on the base 12 and the bridging component 16. The constraining component 40 is fixed on the base 12, such as fixing the constraining component 40 on the base 12 by a screw or a rivet. The constraining component 40 can block a movement of the bridging component 26 in an unlock manner. For example, the constraining component 40 can movably contact against the bottom surface 261 of the bridging component 26, so the bridging component 26 can rotate relative to the base 12 and further slide relative to the constraining component 40. Therefore, the constraining component 40 and a combination of the terminal and the annular slot structure can effectively prevent the bridging component 26 from separating from the accommodating space 38 of the base 12.

In conclusion, the rotary plug of the present invention disposes the plurality of conductive components inside the annular slot structures of the base individually. The parts of the second ends of the positive terminal, the negative terminal and the grounding terminal protruding from the lateral surface of the bridging component are arranged separately. The bridging component can revolve on its own axis (a longitudinal axis of the cylinder) relative to the base, to adjust point angles of the positive terminal, the negative terminal and the grounding terminal. As the initial point angles of the terminals of the rotary plug do not align with holes on the socket, the bridging component can be rotated manually to a situation that the initial point angles of the terminals align with the holes on the socket, and the rotary plug of the present invention can be conveniently combined with the socket without twisting the connecting cable. It is to say, rotation of the base of the rotary plug is unnecessary. The connecting cable of the rotary plug does not twist (which means the base is unrotatable), and the bridging component is driven to axially rotate relative to the base for inserting the terminals into the holes on the socket.

Comparing to the prior art, the rotary plug of the present invention has advantages of simple structure and easy operation. The rotation angle of the bridging component can be adjusted before connection with the socket, and the rotary plug can be conveniently combined with the socket which is located at a narrow area and has no tolerance space. Thus, the connecting cable does not twist as the rotary plug is electrically connected to the socket, so that the present invention has preferred operation convenience and preferred market competition.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A rotary plug comprising:

a base whereon an accommodating space is formed;

a first annular slot structure disposed on an inner wall of the accommodating space, a first hole being formed on the first annular slot structure;

a second annular slot structure disposed on the inner wall of the accommodating space and different from a position of the first annular slot structure, a second hole being formed on the second annular slot structure;

a first conductive component disposed inside the first annular slot structure, the first conductive component comprising a first protrusion, and the first protrusion inserting into the first hole;

a second conductive component disposed inside the second annular slot structure, the second conductive component comprising a second protrusion, and the second protrusion inserting into the second hole;

a bridging component rotatably disposed inside the accommodating space;

a positive terminal, a first end of the positive terminal protruding from a bottom surface of the bridging component, a second end of the positive terminal protruding from a lateral surface of the bridging component and movably inserting into the first annular slot structure for contacting the first conductive component, wherein the second end of the positive terminal is clamped by two inner lateral walls of the first annular slot structure for preventing the bridging component from separating from the accommodating space; and a negative terminal, a first end of the negative terminal protruding from the bottom surface of the bridging component, a second end of the negative terminal protruding from the lateral surface of the bridging component and movably inserting into the second annular slot structure for contacting the second conductive component.

2. The rotary plug of claim 1, wherein the bridging component is a cylinder, the accommodating space is a circular sunken space, the cylinder rotatably inserts into the circular sunken space in a loose fit manner.

3. The rotary plug of claim 1, wherein a depth of the first annular slot structure is substantially greater than a thickness of the first conductive component.

4. The rotary plug of claim 1, further comprising:

a constraining component disposed on the base and the bridging component for preventing the bridging component from separating from the accommodating space.

5. The rotary plug of claim 1, wherein a length of the first protrusion is substantially greater than a depth of the first hole, and the first protrusion passes through the first hole to protrude out of an outer surface of the base.

6. The rotary plug of claim 1, wherein a distance between the second end of the positive terminal and the bottom surface of the bridging component is substantially different from a distance between the second end of the negative terminal and the bottom surface of the bridging component.

7. The rotary plug of claim 1, further comprising:

a third annular slot structure disposed on the inner wall of the accommodating space and different from position of the first annular slot structure and the second annular slot structure, a third hole being formed on the third annular slot structure;

a third conductive component disposed inside the third annular slot structure, the third conductive component comprising a third protrusion, and the third protrusion inserting into the third hole; and a grounding terminal, a first end of the grounding terminal protruding from the bottom surface of the bridging component, a second end of the grounding terminal protruding from the lateral surface of the bridging component and movably inserting into the third annular slot structure for contacting the third conductive component.

8. The rotary plug of claim 7, wherein a distance between the second end of the grounding terminal and the bottom surface of the bridging component is substantially different from distances between the second end of the positive terminal and the bottom surface of the bridging component, and between the second end of the negative terminal and the bottom surface of the bridging component.

9. The rotary plug of claim 7, further comprising:

a connecting cable, the connecting cable comprising a first wire, a second wire and a third wire electrically connected to the second ends of the positive terminal, the negative terminal and the grounding terminal respectively.

10. The rotary plug of claim 9, further comprising:

a covering component disposed on an outer surface of the base, the wires of the connecting cable passing through the covering component to electrically connect to the second ends of the positive terminal, the negative terminal and the grounding terminal respectively.

11. A rotary plug comprising:

a base whereon an accommodating space is formed;

a first annular slot structure disposed on an inner wall of the accommodating space, a first hole being formed on the first annular slot structure;

a second annular slot structure disposed on the inner wall of the accommodating space and different from a position of the first annular slot structure, a second hole being formed on the second annular slot structure;

a first conductive component disposed inside the first annular slot structure, the first conductive component comprising a first protrusion, and the first protrusion inserting into the first hole;

a second conductive component disposed inside the second annular slot structure, the second conductive component comprising a second protrusion, and the second protrusion inserting into the second hole;

a bridging component rotatably disposed inside the accommodating space;

a positive terminal, a first end of the positive terminal protruding from a bottom surface of the bridging component, a second end of the positive terminal protruding from a lateral surface of the bridging component and movably inserting into the first annular slot structure for contacting the first conductive component; and a negative terminal, a first end of the negative terminal protruding from the bottom surface of the bridging component, a second end of the negative terminal protruding from the lateral surface of the bridging component and movably inserting into the second annular slot structure for contacting the second conductive component;

wherein a depth of the first annular slot structure is substantially greater than a thickness of the first conductive component.

12. The rotary plug of claim 11, wherein the bridging component is a cylinder, the accommodating space is a circular sunken space, the cylinder rotatably inserts into the circular sunken space in a loose fit manner.

13. The rotary plug of claim 11, further comprising:

a constraining component disposed on the base and the bridging component for preventing the bridging component from separating from the accommodating space.

14. The rotary plug of claim 11, wherein a length of the first protrusion is substantially greater than a depth of the first hole, and the first protrusion passes through the first hole to protrude out of an outer surface of the base.

15. The rotary plug of claim 11, wherein a distance between the second end of the positive terminal and the bottom surface of the bridging component is substantially different from a distance between the second end of the negative terminal and the bottom surface of the bridging component.

16. The rotary plug of claim 11, further comprising:

a third annular slot structure disposed on the inner wall of the accommodating space and different from position of the first annular slot structure and the second annular slot structure, a third hole being formed on the third annular slot structure;

a third conductive component disposed inside the third annular slot structure, the third conductive component comprising a third protrusion, and the third protrusion inserting into the third hole; and a grounding terminal, a first end of the grounding terminal protruding from the bottom surface of the bridging component, a second end of the grounding terminal protruding from the lateral surface of the bridging component and movably inserting into the third annular slot structure for contacting the third conductive component.

17. The rotary plug of claim 16, wherein a distance between the second end of the grounding terminal and the bottom surface of the bridging component is substantially different from distances between the second end of the positive terminal and the bottom surface of the bridging component, and between the second end of the negative terminal and the bottom surface of the bridging component.

18. The rotary plug of claim 16, further comprising:

a connecting cable, the connecting cable comprising a first wire, a second wire and a third wire electrically connected to the second ends of the positive terminal, the negative terminal and the grounding terminal respectively.

19. The rotary plug of claim 18, further comprising:

a covering component disposed on an outer surface of the base, the wires of the connecting cable passing through the covering component to electrically connect to the second ends of the positive terminal, the negative terminal and the grounding terminal respectively.

* * * * *